US012383071B2

(12) United States Patent
Harbar et al.

(10) Patent No.: US 12,383,071 B2
(45) Date of Patent: Aug. 12, 2025

(54) MULTI-SEGMENT FOLDABLE BED GUARD RAIL

(71) Applicant: MUNOKID LLC, Estero, FL (US)

(72) Inventors: Cezary Michal Harbar, Estero, FL (US); Miao Zhou, Shenzhen (CN)

(73) Assignee: MUNOKID LLC

( * ) Notice: Subject to any disclaimer, the term of this patent is extended or adjusted under 35 U.S.C. 154(b) by 427 days.

(21) Appl. No.: 17/989,866

(22) Filed: Nov. 18, 2022

(65) Prior Publication Data

US 2024/0148154 A1 May 9, 2024

(30) Foreign Application Priority Data

Nov. 4, 2022 (CN) ..... 202211373420.5

(51) Int. Cl.
*A47C 21/08* (2006.01)

(52) U.S. Cl.
CPC ..... *A47C 21/08* (2013.01)

(58) Field of Classification Search
None
See application file for complete search history.

(56) References Cited

U.S. PATENT DOCUMENTS

2013/0180046 A1* 7/2013 Davis, Jr. ..... A61G 7/1026 5/81.1 HS

FOREIGN PATENT DOCUMENTS

| | | | | |
|---|---|---|---|---|
| CN | 213487988 U | * | 6/2021 | ..... A47C 21/08 |
| CN | 216166526 U | * | 4/2022 | |
| CN | 216256365 U | * | 4/2022 | |
| CN | 216256403 U | * | 4/2022 | |
| CN | 216396314 U | * | 4/2022 | |

* cited by examiner

*Primary Examiner* — Adam C Ortiz
(74) *Attorney, Agent, or Firm* — JEEN IP LAW, LLC

(57) ABSTRACT

Disclosed is a multi-segment foldable bed guard rail, comprising a guard rail body with extension portions respectively articulated to the left side and the right side of the guard rail body, a first pivoting member is provided in the middle of the guard rail body, second pivoting members are respectively articulated to the left side and the right side of the guard rail body, the two extension portions are respectively articulated to the second pivoting members, and support portions insertable under a mattress are connected to the bottom of the guard rail body. The multi-segment foldable bed guard rail can have the advantages that a space occupied is small during storage on the premising of achieving the functions of a conventional foldable bed guard rail; specifically designed to fit a carry-on case to meet the user's travel needs.

14 Claims, 9 Drawing Sheets

MULTI-SEGMENT FOLDABLE BED GUARD RAIL

CROSS-REFERENCE TO RELATED APPLICATIONS

This application claims the benefit and priority of Chinese patent application No. 202211373420.5, filed on Nov. 4, 2022, disclosure of which is hereby incorporated by reference in its entirety.

TECHNICAL FIELD

The present invention relates to the field of bed guard rails for children, and more particularly to a multi-segment foldable bed guard rail.

BACKGROUND

In order to prevent children from getting injured due to falling from beds onto floors, more and more families with young children choose to mount bed guard rails at the bedsides of conventional beds. The existing bed guard rail of this kind is generally composed of a body of the bed guard rail and supporting feet, where the body consists of left and right columns and connecting rods connected between the two columns, and the support feet insertable under a mattress are connected to the bottom ends of the columns. Such a bed guard rail can only be fixed at home, and when it is required to carry the bed guard rail outside the home, the conventional bed guard rail is very difficult to store and carry due to its relatively large size.

In order to solve the problem, Chinese Patent with Publication No. CN 114642328 A discloses a bed guard rail, and Chinese Patent with Publication No. CN 217065876 U also discloses a bed guard rail. Both of the above-mentioned patent application documents set forth the technical solution that, after the length of a guard rail body is decreased on the basis of a bed guard rail with an existing structure, left and right side wings of the guard rail body are respectively provided with an extension portion which are rotatable relative to the middle guard rail body for folding or unfolding, and the sum of the lengths of the guard rail body and the unfolded extension portions is just the same as the length of the conventional guard rail, thereby enabling the folded guard rail to be also conveniently carried due to small space occupation.

Although the above-mentioned technical solution enables the size of the guard rail to be decreased after folding compared with the conventional guard rail, in actual use of the product, since the side of the conventional bed generally has a length of 1.8-2 meters, the space occupied by the whole folded bed guard rail is still relatively large even after the extension portions of the two wings are folded toward the middle, and it is difficult to store the guard rail in a common case, and it can be carried out with a large luggage case or a separate storage package, which would still cause great trouble during carrying, and also bring great inconvenience during product packaging and transportation.

In addition, an existing foldable bed guard rail has a very complicated structure in its folding-locking portions, and has a large number of parts needing to be matched with each other. Not only is it cumbersome and inconvenient to assemble and maintain, but such a complicated structure also makes production efficiency reduced greatly.

SUMMARY

The object of the present invention is to provide a multi-segment foldable bed guard rail, which is designed to be compact enough to fit in a carry-on case, is firm, durable, and convenient to carry and occupies a small storage space after folded.

To achieve the above objective, the present invention adopts the technical solution as follows: a multi-segment foldable bed guard rail, including a guard rail body with foldable/unfoldable extension portions respectively articulated to the left side and the right side of the guard rail body, and characterized in that a first pivoting member enabling the guard rail body to be folded in half is provided in the middle of the guard rail body, first abutting portions only enabling the guard rail body to be turned by 90 degrees during unfolding are provided on the sides of positions where the guard rail body and the first pivoting member are articulated to each other, second pivoting members are respectively articulated to the left side and the right side of the guard rail body, the two extension portions are respectively articulated to the second pivoting members on the corresponding sides, and second abutting portions only enabling the extension portions to be turned by 90 degrees during unfolding are provided at the sides of positions where the second pivoting members are articulated to the corresponding extension portions, and support portions insertable under a mattress are connected to the bottom of the guard rail body.

As a further solution of the present invention, the first pivoting member includes a first rotary shaft seat and a second rotary shaft seat respectively provided in a perpendicularly spaced manner, the guard rail body includes a left guard rail articulated to the left side of the first rotary shaft seat and the second rotary shaft seat, and a right guard rail articulated to the right side of the first rotary shaft seat and the second rotary shaft seat, first abutting portions are provided on the sides of the axis positions of the first rotary shaft seat and the second rotary shaft seat respectively articulated to the left guard rail and the right guard rail, and the second pivoting members are respectively provided on the left side of the left guard rail and the right side of the right guard rail.

As a further solution of the present invention, the second pivoting members include third rotary shaft seats and fourth rotary shaft seats that are respectively articulated to the left side of the left guard rail and the right side of the right guard rail and are correspondingly provided in a vertically symmetrical manner, the extension portions are respectively articulated to the sides of the adjacent third rotary shaft seat and the adjacent fourth rotary shaft seat away from the guard rail body, the second abutting portions are provided on the sides of the axis positions of the third rotary shaft seats and the fourth rotary shaft seats articulated to the corresponding extension portions, and the support portions are telescopically provided on the left and right fourth rotary shaft seats respectively.

As a further solution of the present invention, the support portions include telescopic vertical rods respectively vertically inserted into each of the fourth rotary shaft seats, the bottom ends of the telescopic vertical rods penetrate through the bottoms of the fourth rotary shaft seat where they are located, and extend out below the fourth rotary shaft seats, and support plates are horizontally fixedly connected to the bottom ends of the telescopic vertical rods respectively extending out below the fourth rotary shaft seats.

As a preferred embodiment of the present invention, connecting plates are horizontally articulated to the ends of the two support plates away from the corresponding telescopic vertical rods, and a buckle capable of connecting the connecting plates together is provided between end portions of the two connecting plates.

As a preferred aspect of the present invention, the extension portion includes a C-shaped frame, with the upper end and the lower end thereof respectively articulated to the outer sides of the adjacent third rotary shaft seat and the adjacent fourth rotary shaft seat.

As a preferred aspect of the present invention, a middle column is connected between the first rotary shaft seat and the second rotary shaft seat.

As a preferred solution of the present invention, hollow side columns are respectively connected between the third rotary shaft seats and the fourth rotary shaft seats that are connected to the left side of the left guard rail and the right side of the right guard rail, the top ends of the telescopic vertical rods penetrate through the fourth rotary shaft seats where the top end are located, to be inserted into the corresponding side columns, and telescopic locking members capable of locking the extending lengths of the telescopic vertical rods are respectively provided on the fourth rotary shaft seats connected to the left side of the left guard rail and the right side of the right guard rail.

As a preferred solution of the present invention, the telescopic locking member includes an accommodating cavity connected to one side of the fourth rotary shaft seat, the outer side wall of the accommodating cavity facing away from the telescopic vertical rod is open, and a first unlocking button turnable in a left-right direction in a bridge plate manner is articulated in the accommodating cavity; a first locking pin is connected to one side of the bottom end of the first unlocking button, a first return spring capable of returning after the first unlocking button generates a seesawing action is connected to one side of the top end of the first unlocking button, and a plurality of first positioning holes for insertion or extraction of the first locking pins are formed in a side wall of the telescopic vertical rod, and are sequentially arranged at intervals in the length direction of the telescopic vertical rod.

As a preferred solution of the present invention, main guard rail locking devices capable of locking the left guard rail and the right guard rail in a relatively straight line state after unfolding are respectively provided on the first rotary shaft seat and the second rotary shaft seat; the main guard rail locking device includes accommodating cavities respectively formed in the first rotary shaft seat and the second rotary shaft seat, guide columns are vertically provided in the accommodating cavities, and the guide columns are sleeved with bearing plates; second positioning holes are formed in the sides of the axes of the articulated shafts by which the left guard rail and the right guard rail are respectively articulated to the first rotary shaft seat and the second rotary shaft seat, and insertion holes capable of being in communication with the accommodating cavities respectively are formed in the first rotary shaft seat and the second rotary shaft seat at the positions corresponding to the second positioning holes; pressing rods capable of extending out of the first rotary shaft seat or the second rotary shaft seat where the pressing rods are located are further provided on the bearing plates, and the guide columns are sleeved with second return springs capable of resetting again after the pressing rods drive the bearing plates to displace along the guide columns, with one end of each of the second return springs pressing against an end portion of the corresponding guide column and the other end thereof pressing against the bottom of the corresponding bearing plate.

As a preferred solution of the present invention, the buckle includes a male fastening element provided at an end portion of one of the connecting plates and a female insertion slot provided at an end portion of the other of the connecting plates, where a side wall of an end portion of the female insertion slot has an insertion port capable of allowing the male fastening element to be inserted, a snap-fit opening capable of being in communication with the insertion port is formed in the top of the female insertion slot, the top of the male fastening element has a snap with a tail end capable of upwarping, and after the snap is inserted into the insertion port along with the male fastening element, the tail upwarps to be snapped into the snap-fit opening.

As a preferred solution of the present invention, a fixture block is provided on the fourth rotary shaft seat and/or the third rotary shaft seat articulated to the left guard rail together, and a catch capable of being in clamped connection with the fixture block is provided on the fourth rotary shaft seat and/or the third rotary shaft seat articulated to the right guard rail together.

As a preferable solution of the present invention, the two connecting plates are respectively sleeved with an anti-slip rubber sleeve.

As a preferred solution of the present invention, angle limiting pieces capable of cooperating with each other to limit rotation angles of the connecting plates relative to the articulated support plates are provided at the positions where the connecting plates are articulated to the support plates; the angle limiting piece includes a first limiting part provided on the side wall of the connecting plate close to the end portion and extending out upwards, and a second limiting part fixedly provided on the side wall of the corresponding end portion of the support plate, where a side wall of the first limiting part presses against a side wall of the second limiting part after the first limiting part rotates by 90 degrees along with the connecting plate.

As a preferable solution of the present invention, the left and right guard rails and the left and right side frames are sleeved with cloth sleeves.

In summary, compared with the prior art, the present invention has the beneficial effects that first, according to the present invention, by adopting the solution in which a guard rail in the middle portion of a conventional bed guard rail is made into a left guard rail and a right guard rail that are foldable, and frames capable of increasing the length after the left guard and the right guard rail are unfolded are then articulated to two sides of the left guard rail and the right guard rail, the multi-segment foldable bed guard rail can have the advantages that the space occupied is small during storage on the basis of the conventional foldable bed guard rail; even a common case or a traveling bag for carrying can also store the guard rail without separately customizing or purchasing large packaging, and the guard rail does not occupy too much space when being placed on a car or a luggage rack, thereby meeting the travel need of a user; second, the safety of the guard rail can be further ensured by the main guard rail locking devices simple in structure. The simple structure will not be prone to failure due to a large number of parts, so it is quick and convenient to assemble and manufacture, improving the production efficiency.

DETAILED DESCRIPTION

Figure 1:
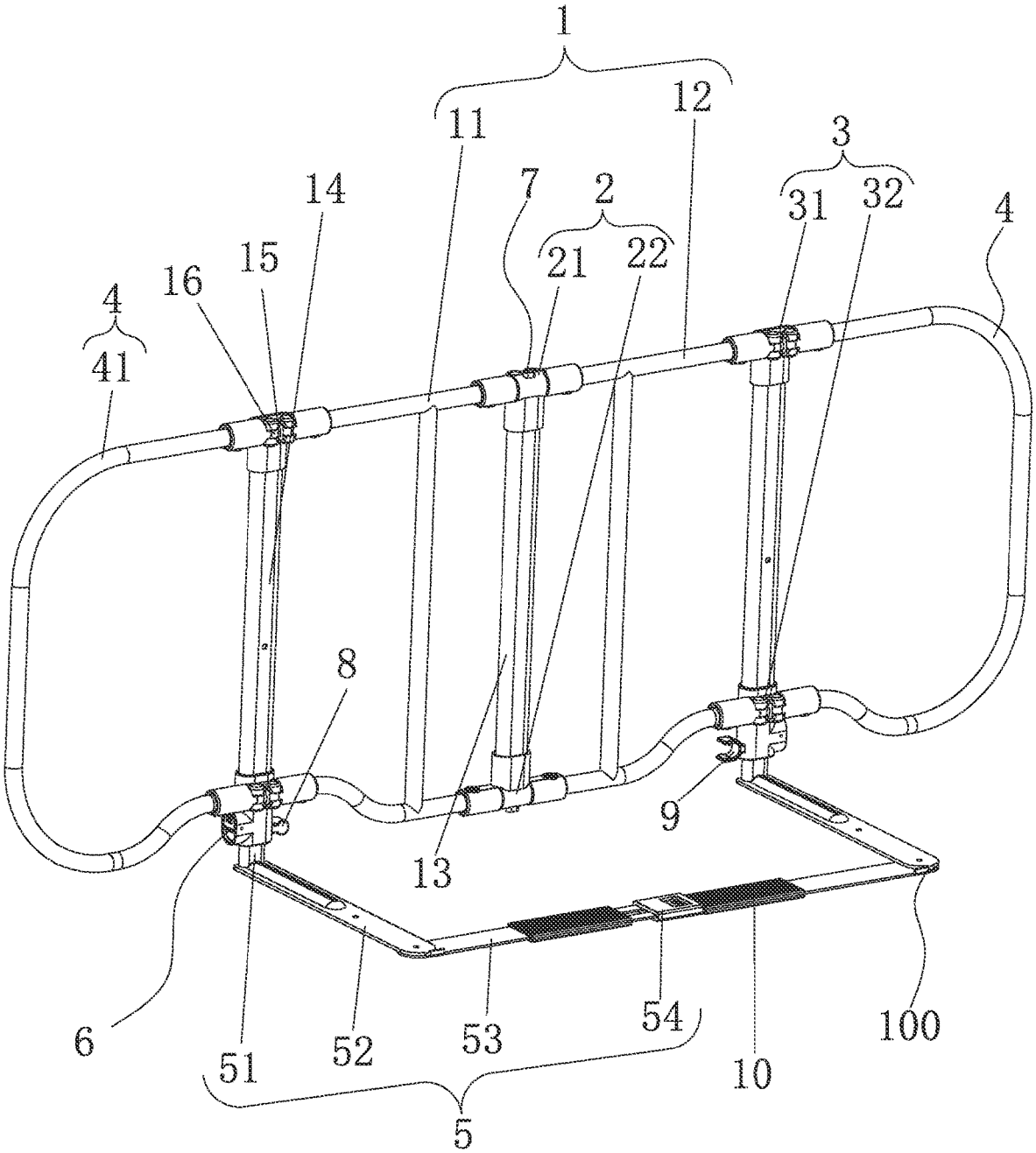
FIG. 1 is a perspective view of the present invention after unfolding.
Figure 2:
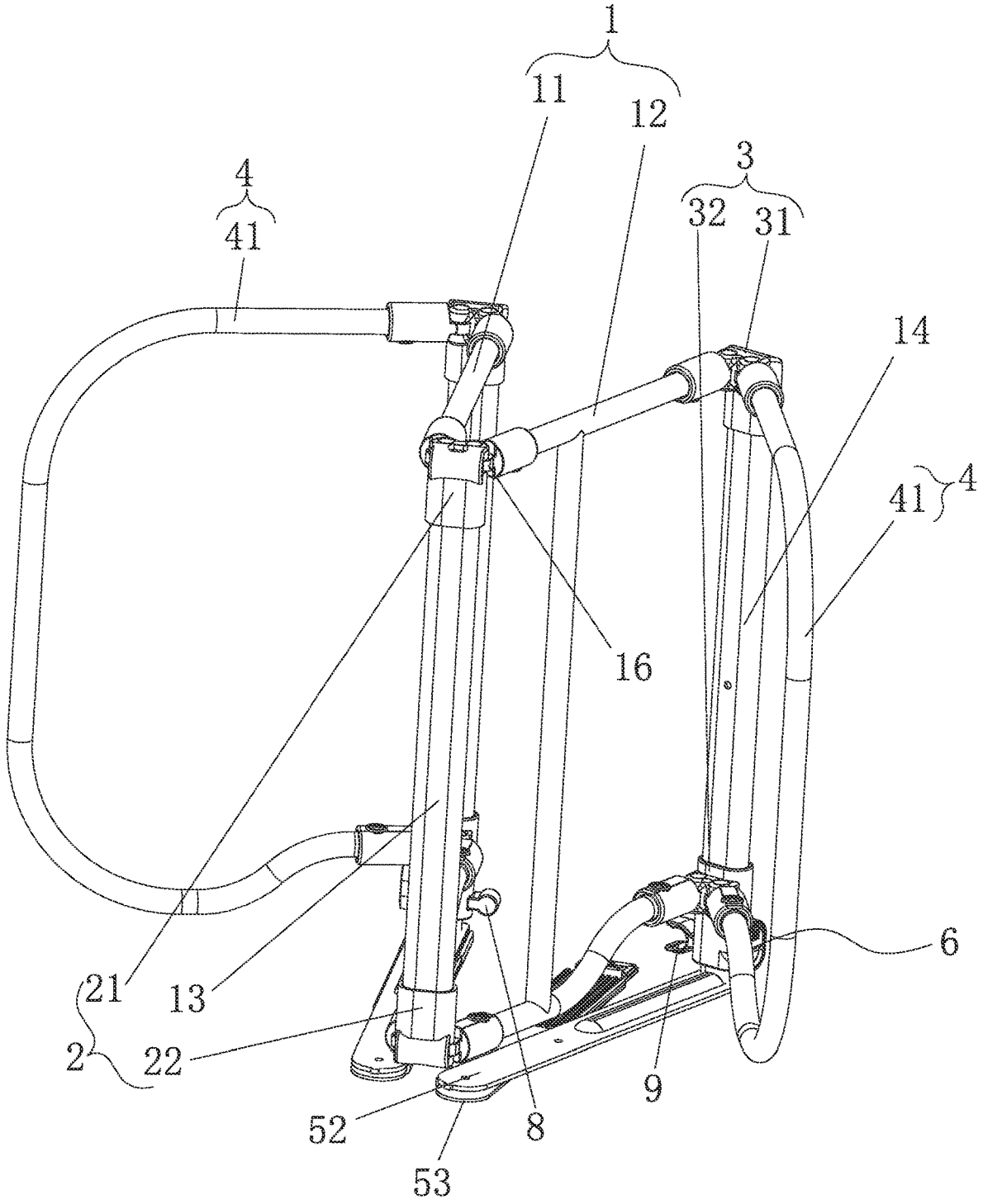
FIG. 2 is a perspective view of the present invention during folding.
Figure 3:
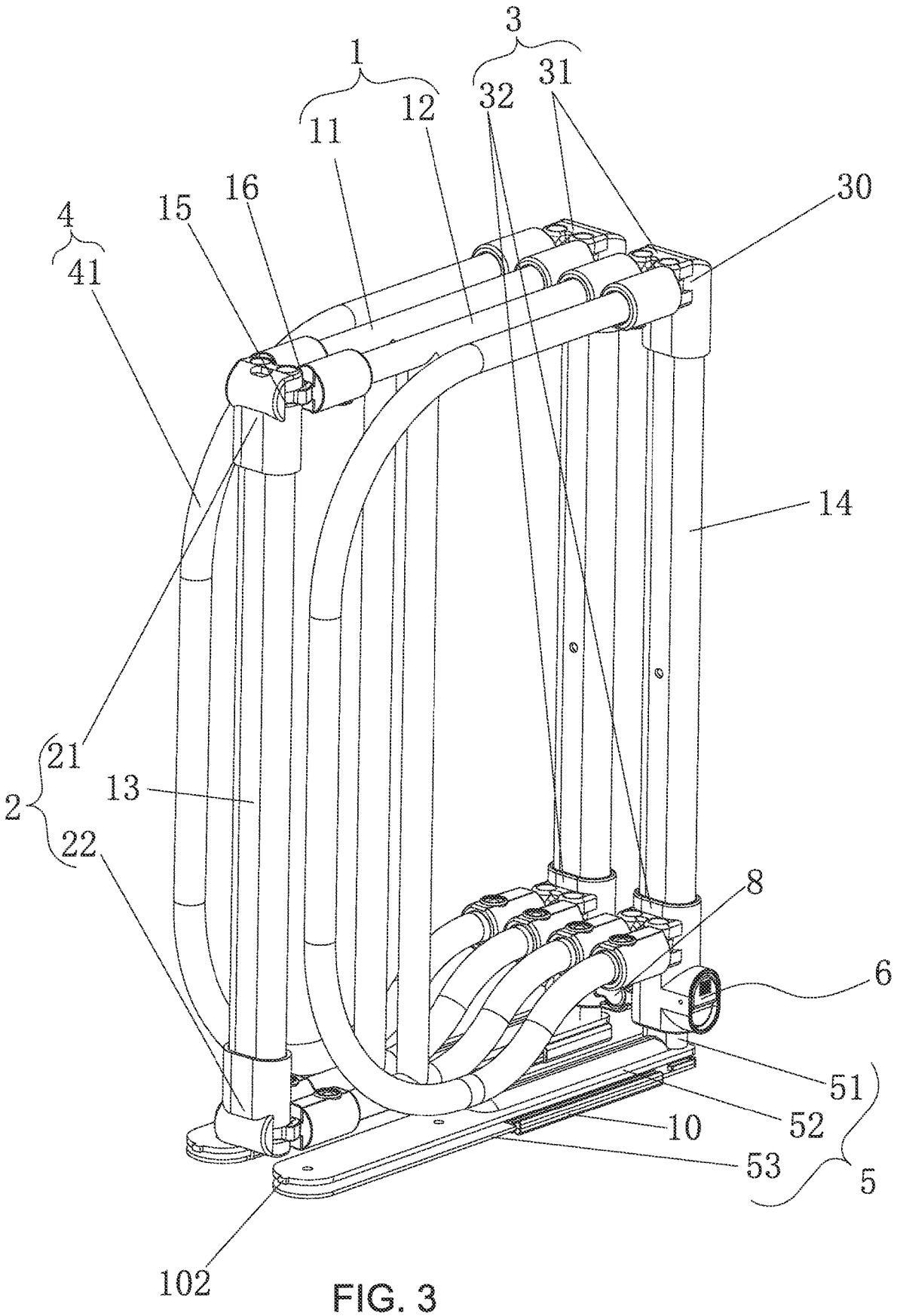
FIG. 3 is a first perspective view of the present invention after folding.

The detailed description will be provided below to implement various embodiments or examples of the present invention. Of course, these embodiments or examples are merely illustrative and are not intended to be limiting. In addition, repeated reference numerals, such as repeated numbers and/or letters, may be used in different embodiments. These repetitions are used for simply and clearly describing present invention and do not represent the specific relationships between the various embodiments and/or structures discussed.

Moreover, spatially relative terms may be used herein, such as "below", "on the lower side", "from inside to outside", "above", "on the upper side", etc., these terms are used for facilitating the description of the relationship between one element or feature and another element or feature or between some elements or features and other elements or features in the drawings, and such spatially relative terms include different orientations of a device in use or operation, and the orientations depicted in the drawings. The device may be turned to different orientations by 90 degrees or to other orientations, the spatially relative adjectives used therein may be similarly interpreted, and therefore, shall not be construed as limiting the present invention, and the terms "first" and "second" are used for descriptive purposes only and shall not be construed as indicating or implying relative importance or implicitly indicating the number of technical features indicated. Thus, the features defined with "first" and "second" may explicitly or implicitly include one or more of the features.

Figure 7:
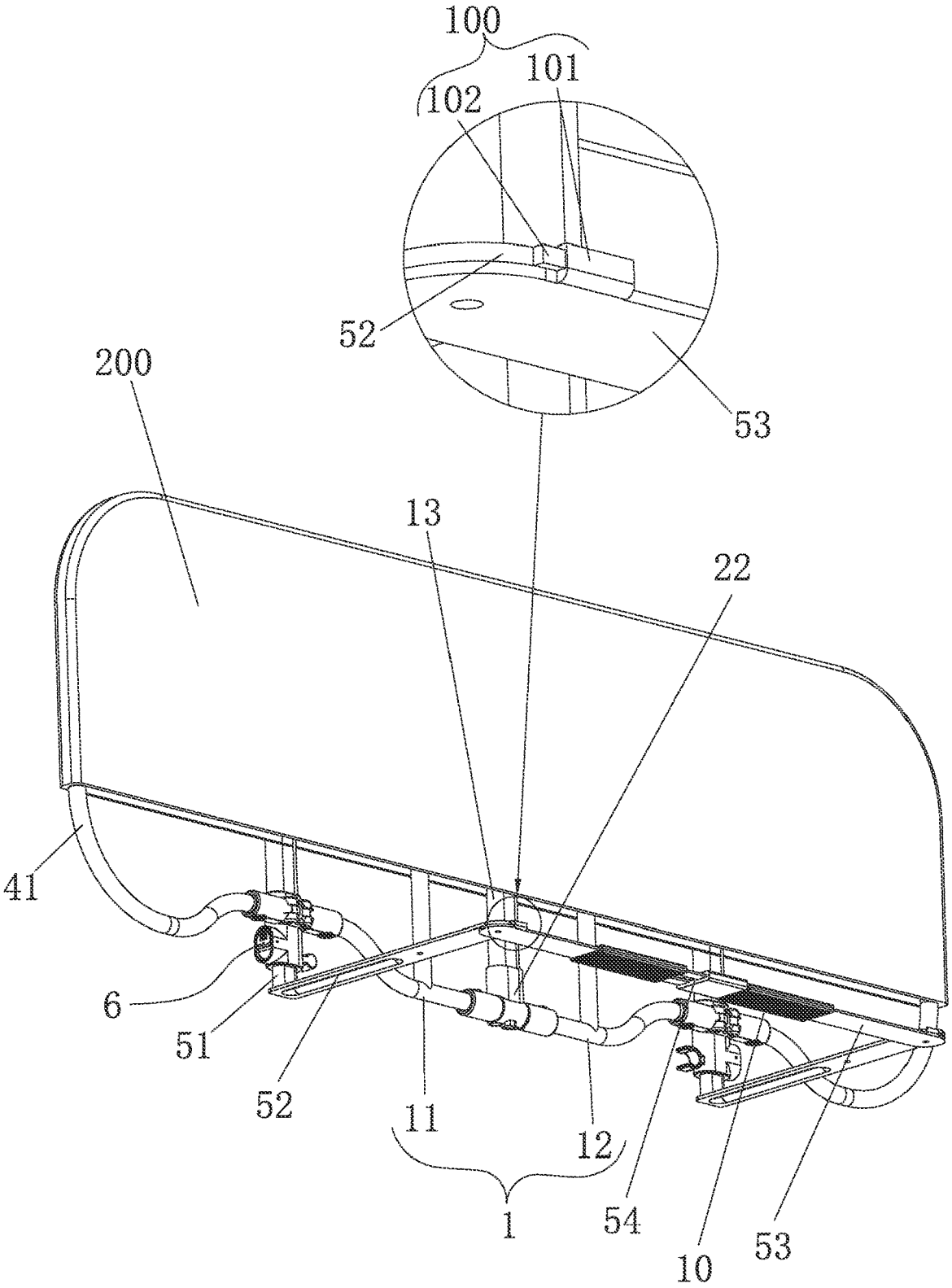
FIG. 7 is a perspective view of the present invention sleeved with a cloth cover after unfolding.
Figure 8:
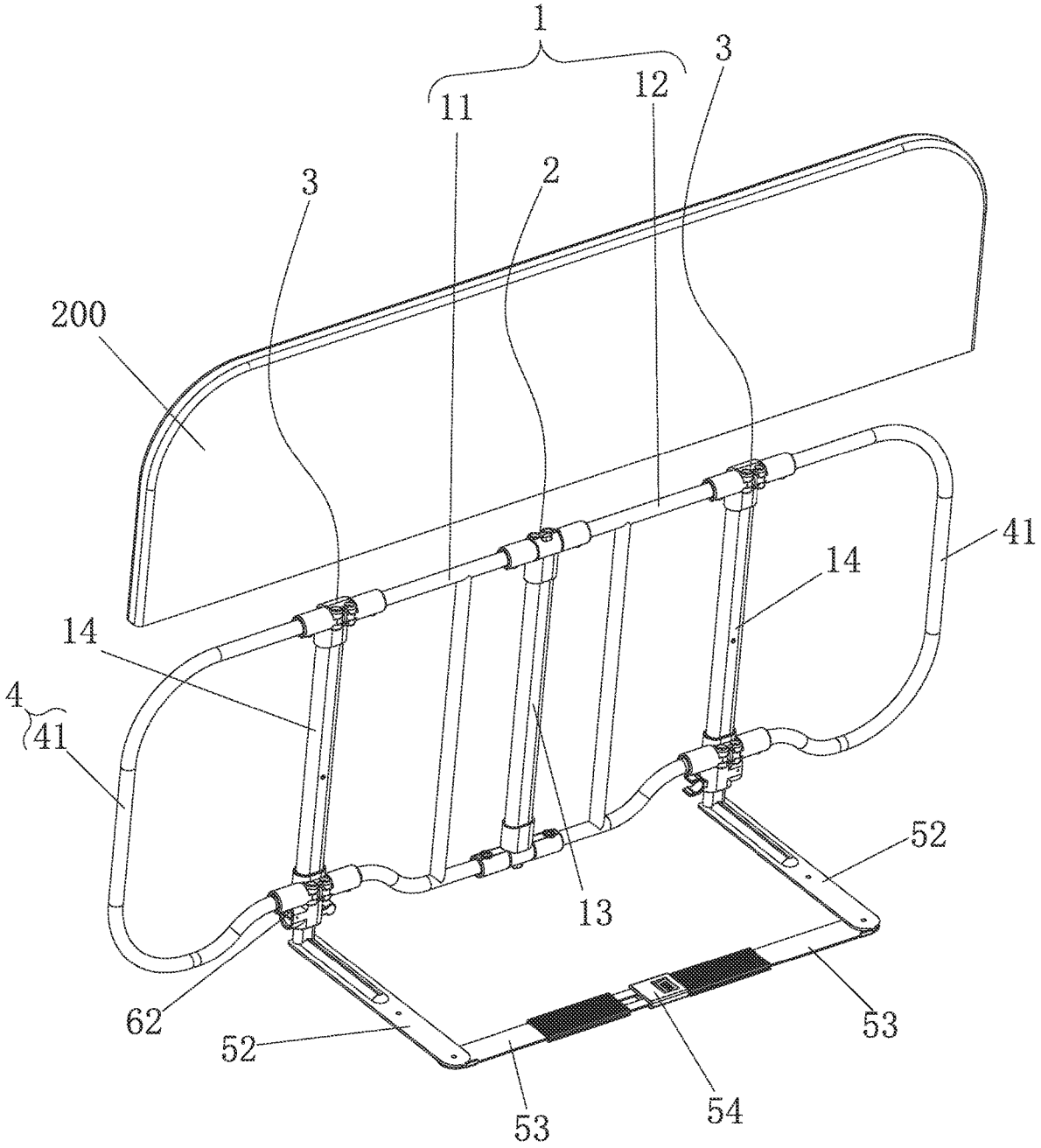
FIG. 8 is an exploded view of the present invention and the cloth cover.
Figure 9:
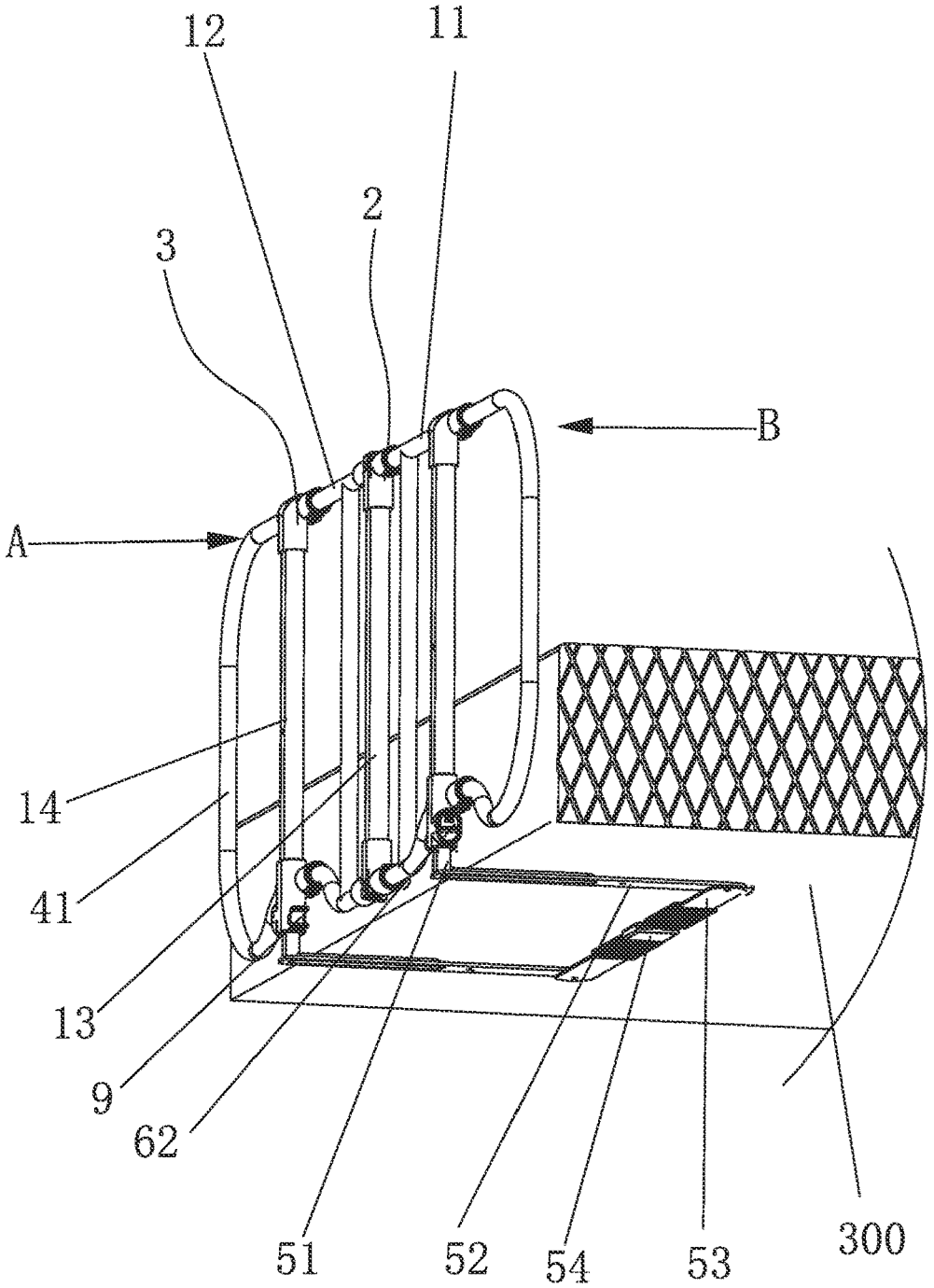
FIG. 9 is a schematic state view illustrating support portions inserted under a mattress after the present invention is unfolded.

The present invention will be further described with reference to the accompanying drawings and detailed description: as shown in FIGS. 1 to 9, a multi-segment foldable bed guard rail includes a guard rail body 1 composed of a left guard rail 11 and a right guard rail 12, a middle column 13 is vertically provided between the left guard rail 11 and the right guard rail 12, side columns 14 are respectively articulated to the ends of the left guard rail 11 and the right guard rail 12 away from the middle column 13, and foldable/unfoldable extension portions 4 are respectively articulated to the side columns 14 on the left side and the right side of the guard rail body 1; a first pivoting member 2 enabling the left guard rail 11 and the right guard rail 12 to be oppositely folded in half is provided on the middle column 13 in the middle of the guard rail body 1, first abutting portions 20 only enabling the first pivoting member 2 for articulating the left guard rail 11 and the right guard rail 12 to be turned by 90 degrees when the left guard rail 11 and the right guard rail 12 are oppositely unfolded, are provided at the sides of articulated shafts by which the left guard rail 11 and the right guard rail 12 are articulated to the first pivoting member 2 each other, that is to say, when both the left guard rail 11 and the right guard rail 12 are unfolded, the left guard rail 11 and the right guard rail 12 can only be on the same straight line; second pivoting members 3 are respectively articulated to the left side of the left guard rail 11 and the right said of the right guard rail 12, that is to say, the second pivoting members 3 are provided on the side columns 14; therefore, the side columns 14 are rotatable relative to the left guard rail 11 and the right guard rail 12 where the side columns are located, one extension portion 4 is articulated to the second pivoting member 3 corresponding to the side column 14 where the left side of the left guard rail 11 is located, and the other extension portion 4 is articulated to the second pivoting member 3 corresponding to the side column 14 where the right side of the right guard rail 12 is located; second abutting portions 30 only enabling, when the extension portions 4 are unfolded, the extension portions 4 to be turned by 90 degrees relative to the second pivoting members 3 where the extension portions 4 are located are provided at the sides of the axis positions where the second pivoting members 3 are articulated to the corresponding extension portions 4; and support portions 5 instable under a mattress 300 are connected to the bottom of the guard rail body 1. With the compact foldable structure, the multi-segment foldable bed guard rail described in the above embodiment has the structure and features of a conventional bed guard rail with left and right wings foldable toward its middle, the guard rail body 1 in the middle are also foldable in half, so that the space occupied by the whole bed guard rail is greatly reduced after it is folded. A test shows that such a foldable structure has enabled the bed guard rail to be put into a common carried case such as a small carry-on case, or some traveling bags such as a suitcase. Thus, there is no need for additional packaging or more space to carry the folded bed guard rail. As shown in FIG. 9, in use, after the left guard rail 11 and the right guard rail 12 and the extension portions 4 respectively located on the left side wing and the right side wing are unfolded to form a vertical surface, the support portions 5 are inserted under the mattress 300 such that the mattress 300 presses against the support portions 5. In this case, when the left guard rail 11 and the right guard rail 12 are pushed toward the outer side of a bed (in the direction indicated by arrow B in the figure), the left guard rail 11 and the right guard rail 12 cannot be turned toward the outer side of the bed due to the presence of the first abutting portions 20, while when the left guard rail 11 and the right guard rail 12 are pushed toward the inner side of the bed (in the direction indicated by arrow A in the figure), the mattress 300 will just abut against the lower portions of the left guard rail 11 and the right guard rail 12 by relying on the thickness thereof, such that the left guard rail 11 and the right guard rail 12 cannot be turned toward the center of the bed, and the extension portions 4 on the two sides have the same principle as the left guard rail 11 and the right guard rail 12, such that the bed guard rail cannot be turned and folded by a pushing force, and the safety of a child can thus be ensured during activity.

Figure 5:
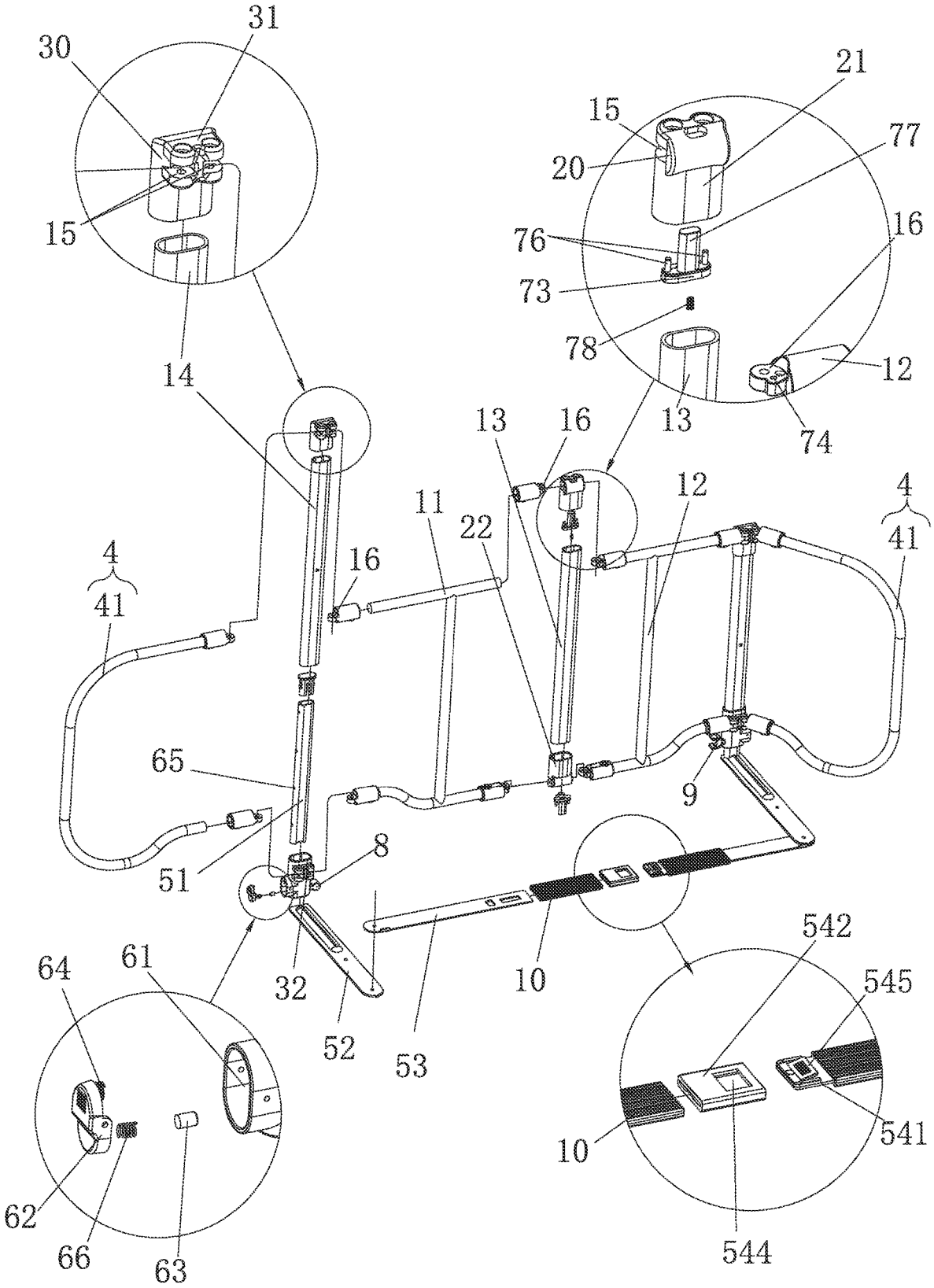
FIG. 5 shows an exploded view of the present invention, and enlarged views of partial areas in the figure.

In the embodiment, the first pivoting member 2 includes a first rotary shaft seat 21 and a second rotary shaft seat 22 that are respectively provided at the top end and the bottom end of the middle column 13 in a perpendicularly spaced manner, the left guard rail 11 and the right guard rail 12 are each made of a I-shaped metal pipe fitting, the upper end and the lower end of the right side of the left guard rail 11 are respectively articulated to the left side of the first rotary shaft seat 21 and the left side of the second rotary shaft seat 22, and the upper end and the lower end of the left side of the right guard rail 12 are respectively articulated to the right side of the first rotary shaft seat 21 and the right side of the second rotary shaft seat 22; and the second pivoting members 3 include third rotary shaft seats 31 and fourth rotary shaft seats 32 that are respectively articulated to two left end portions of the left side of the left guard rail 11 and two right end portions of the right side of the right guard rail 12; the extension portion 4 includes a C-shaped frame 41, in the embodiment, the frame 41 on the left side is articulated to the third rotary shaft seat 31 and the fourth rotary shaft seat 32 provided on the side column 14 on one side of the left guard rail 11, the frame 41 on the right side is articulated to the third rotary shaft seat 31 and the fourth rotary shaft seat 32 provided on the side column 14 on one side of the right guard rail 12, and two end portions of the frame 41 are respectively articulated to the corresponding third rotary shaft seat 31 and the corresponding fourth rotary shaft seat 32; the first abutting portion 20 is provided on one side of the axis position where the first rotary shaft seat 21 and the second rotary shaft seat 22 are respectively articulated to the left guard rail 11 and the right guard rail 12, and the second abutting portions 30 are provided on the sides of the axis positions of the third rotary shaft seat 31 and the fourth rotary shaft seat 32 respectively articulated to the corresponding extension portions 4; specifically, the first rotary shaft seat 21 and the second rotary shaft seat 22 are respectively pipe sleeves sheathed on the upper end and the lower end of the middle column 13, the pipe sleeve-shaped ends of the first rotary shaft seat 21 and the second rotary shaft seat 22 away from the end portions of the middle column 13 are in a closed state, the sides of the first rotary shaft seat 21 and the second rotary shaft seat 22 away from the end portions of the middle column 13 are respectively provided with two grooves 15 that are mutually horizontal in a left-right direction, the ends portions of the left guard rail 11 and the right guard rail 12 are configured as articulated lugs 16 that are insertable into the grooves 15, and hinge pins are then vertically penetrate the articulated lugs 16 after the articulated lugs 16 are inserted into the grooves 15. As shown in FIG. 5, each groove 15 is open at two sides, and the first abutting portion 20 is located at the closed position of the back of the groove 15; when the left guard rail 11 and the right guard rail 12 are turned from a mutually-parallel oppositely-folded state to a state of being on the same line, the articulated shafts of the left guard rail 11 and the right guard rail 12 are abutted by the first abutting portions 20 and accordingly cannot be turned back again, so that the left guard rail 11 and the right guard rail 12 can form a front vertical surface when the guard rail is unfolded for use. The third rotary shaft seat 31, the fourth rotary shaft seat 32 and the second abutting portion 30 are likewise the same as the first abutting portion 20, the first rotary shaft seat 21 and the second rotary shaft seat 22 in arrangement structure, and the frame 41 is articulated in the same manner as the left guard rail 11 and the right guard rail 12, and the structure shown in the figures may be referred for specific details. It should be noted that the third rotary shaft seat 31 and the fourth rotary shaft seat 32 differ from the first rotary shaft seat 21 and the second rotary shaft seat 22 in that although the third rotary shaft seat 31 and the fourth rotary shaft seat 32 are similarly in the shape of the pipe sleeve, the upper and lower pipe orifices of the third rotary shaft seat 31 and the fourth rotary shaft seat 32 in the shape of the pipe sleeve are open instead of being closed.

In order to enable the bed guard rail to adapt to mattresses with various thicknesses, the support portions 5 are telescopically inserted into the pipe orifices of the left and right fourth rotary shaft seats 32 respectively. Specifically, the support portions 5 include telescopic vertical rods 51 respectively vertically inserted into each of the fourth rotary shaft seats 32, the bottom ends of the telescopic vertical rods 51 extend out below the fourth rotary shaft seats 32 and penetrate through the bottoms of the fourth rotary shaft seat 32 where they are located, support plates 52 are horizontally fixedly connected to the bottom ends of the telescopic vertical rods 51 respectively extending out below the fourth rotary shaft seats 32, the support plates 52 are provided under the mattress, or pressed with a heavy object, and the left guard rail 11, the right guard rail 12 and the side frames 41 on the two sides are thus kept vertical relative to a bed surface.

In order to make the support portions 5 stable under the mattress, as a further solution, connecting plates 53 are horizontally articulated to the ends of the two support plates 52 away from the corresponding telescopic vertical rods 51, and a buckle 54 capable of connecting the connecting plates 53 together is provided between the end portions of the two connecting plates 53. The buckle 54 includes a male fastening element 541 provided at an end portion of one of the connecting plates 53 and a female insertion slot 542 provided at an end portion of the other of the connecting plates 53; a side wall of an end portion of the female insertion slot 542 has an insertion port 543 capable of allowing the male fastening element 541 to be inserted, a snap-fit opening 544 capable of being in communication with the insertion port 543 is formed in the top of the female insertion slot 542, the top of the male fastening element 541 has a snap 545 with a tail end capable of upwarping, and after the snap 545 is inserted into the insertion port 543 along with the male fastening element 541, the tail upwarps to be snapped into the snap-fit opening 544. After the two connecting plates 53 are fixedly connected together by means of the buckle 54, the rotation of the side columns 14 can be further limited, such that when the side frames 41 cannot be turned, the side columns 14 articulated to the left guard rail 11 and the right guard rail 12 will not rotate, thereby ensuring that the left guard rail 11, the right guard rail 12 and the side frames 41 on the two sides can form an entire vertical surface; and the two connecting plates 53 are respectively sleeved with anti-slip rubber sleeves 10 so that the support plates 52 can be further prevented from sliding on the bottom of the mattress, and a frictional force can be increased.

In addition, in order to enable, the support portions 5 that are formed after the two connecting plates 53 are fixedly connected together, to make the side columns 14 firm and incapable of rotating by itself, angle limiting pieces 100 capable of cooperating with each other to limit rotation angles of the connecting plates 53 relative to the articulated support plates 52 are provided at the positions where the connecting plates 53 are articulated to the support plates 52; the angle limiting piece 100 includes a first limiting part 101 provided on the side wall of the connecting plate 53 close to the end portion and extending out upwards, and a second limiting part 102 fixedly provided on the side wall of the corresponding end portion of the support plate 52, wherein a side wall of the first limiting part 101 presses against a side wall of the second limiting part 102 after the first limiting part 101 rotates by 90 degrees along with the connecting plate 53. When the two connecting plates 53 are fastened together, the first limiting parts 101 cooperate with the second limiting parts 102 to form right angles between the connecting plates 53 and the corresponding support plates 52, so that the side columns 14 where the support plates 52 are located cannot rotate, thereby ensuring that the side frames 41 cannot swing after being unfolded.

By adopting the above-mentioned solution, the bed guard rail can be folded easily, and when it is unfolded for use, the left guard rail 11, the right guard rail and the frames 41 articulated thereto are articulated to one another, and the support portions 5 that are rectangular frames formed by means of mutual cooperation and snap-fitting thereof enable the bed guard rail to form the entire vertical surface without bending, thereby ensuring normal use.

Figure 6:
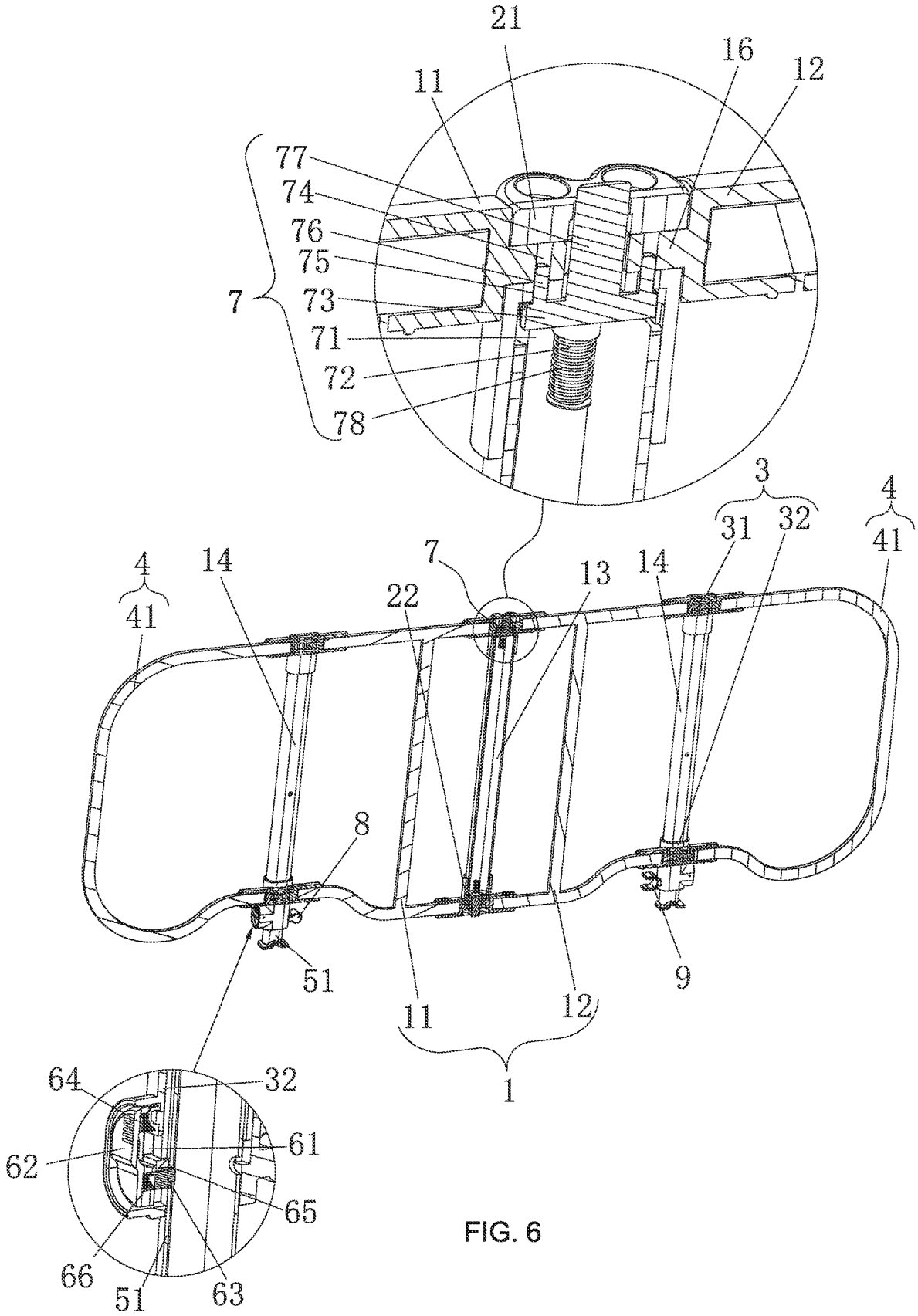
FIG. 6 shows one of a cross-sectional view of the present invention vertically downward in its length direction after unfolding, and enlarged views of partial areas in the figure.

In addition, as shown in FIGS. 5 and 6, in order to well and conveniently increase or decrease the horizontal heights of the left guard rail 11, the right guard rail 12, and the side frames 41 on the two sides, telescopic locking members 6 capable of locking the extending lengths of the telescopic vertical rods 51 are respectively provided on the fourth rotary shaft seats 32 connected to the left side of the left guard rail 11 and the right side of the right guard rail 12.

It can be clearly seen from the figures that the telescopic locking member 6 includes an accommodating cavity 61 connected to one side of the fourth rotary shaft seat 32, the outer side wall of the accommodating cavity 61 facing away from the telescopic vertical rod 51 is open, a first unlocking button 62 which is turnable in a left-right direction in a bridge plate manner is articulated in the accommodating cavity 61, a first locking pin 63 is connected to one side of the bottom end of the first unlocking button 62, and a first return spring 64 capable of returning after the first unlocking button 62 generates a seesawing action is connected to one side of the top end of the first unlocking button 62; a plurality of first positioning holes 65 capable of allowing the first locking pins 63 to be inserted or pulled out penetrate through a side wall of the telescopic vertical rod 51, the first positioning holes 65 are provided at intervals in sequence in the length direction of the telescopic vertical rod 51, and the first locking pin 63 will lose an abutting pressure by pressing the first unlocking button 62; in the embodiment, the first locking pin 63 is in a circular arc shape toward the end portion of the telescopic vertical rod 51, an abutting spring 66 is provided between the first locking pin 63 and the first unlocking button 62 for connection, and in this case, the first locking pin 63 can be allowed to retract from the first positioning hole 65 by pulling the telescopic vertical rod 51; after the first unlocking button 62 is loosened, the first return spring 64 is released to push the first unlocking button 62 to return, and the abutting spring 66 abuts against the first locking pin 63; when another first positioning hole 65 is displaced and then aligned to the end portion of the first locking pin 63, the abutting spring 66 forces the first locking pin 63 to enter the first positioning hole 65. Of course, rigid connection may also be allowed between the first locking pin 63 and the first unlocking button 62, but the first locking pin 63 is required to be smaller than the first positioning hole 65 in thickness. By using such an arrangement, it is convenient to increase or decrease the horizontal heights of the left guard rail 11, the right guard rail 12, and the side frames 41 on the two sides while it is ensured that the adjusted heights cannot changed occasionally.

Moreover, in order to prevent folding positions from being accidentally bent or folded by an external force, main guard rail locking devices 7 capable of oppositely locking the left guard rail 11 and the right guard rail 12 in a straight-line state after unfolding are respectively provided on the first rotary shaft seat 21 and the second rotary shaft seat 22. As shown in FIGS. 5 and 6, in the embodiment, the main guard rail locking device 7 includes accommodating cavities 71 respectively formed in the first rotary shaft seat 21 and the second rotary shaft seat 22, guide columns 72 are vertically provided in the accommodating cavity 71, the guide columns 72 are sleeved with bearing plates 73, a second positioning hole 74 is formed in one side of each of the axes of the articulated shafts by which the left guard rail 11 and the right guard rail 12 are respectively articulated to the first rotary shaft seat 21 and the second rotary shaft seat 22, and insertion holes 75 capable of being in communication with the accommodating cavities 71 are respectively formed in the first rotary shaft seat 21 and the second rotary shaft seat 22 at the positions corresponding to the second positioning holes 74; positioning columns 76 capable of penetrating through the insertion holes 75 to be inserted into the corresponding second positioning holes 74 are respectively provided on the bearing plates 73, pressing rods 77 capable of passing through the first rotary shaft seat 21 or the second rotary shaft seat 22 to extend out are further provided on the bearing plates 73, the guide columns 72 are sleeved with second return springs 78 capable of resetting again after the pressing rods 77 drive the bearing plates 73 to displace along the guide columns 72, with one end of each of the second return spring 78 pressing against an end portion of the corresponding guide column 72 and the other end thereof pressing against the bottom of the corresponding bearing plate 73. After the pressing rods 77 are pressed to displace the bearing plates 73 along the guide columns 72, the positioning columns 76 will retract from the second positioning holes 74, such that the rotary shafts by which the left guard rail 11 and the right guard rail 12 are respectively articulated to the first rotary shaft seat 21 and the second rotary shaft seat 22 can rotate freely; on the contrary, the second reset springs 78 will push the bearing plates 73 to displace along the guide columns 72 for resetting, and the positioning columns 76 will be inserted into the second positioning holes 74. Since the second positioning hole 74 is formed in one side of each of the rotary shafts by which the first rotary shaft seat 21 and the second rotary shaft seat 22 are articulated, the left guard rail 11 and the right guard rail 12 inserted into the second positioning holes 74 by the positioning columns 76 cannot rotate again about their own articulating axes. Furthermore, the folding phenomenon is further prevented when the left guard rail 11 and the right guard rail 12 are pushed by a child or an external force, thereby realizing a function of dual locking.

Figure 4:
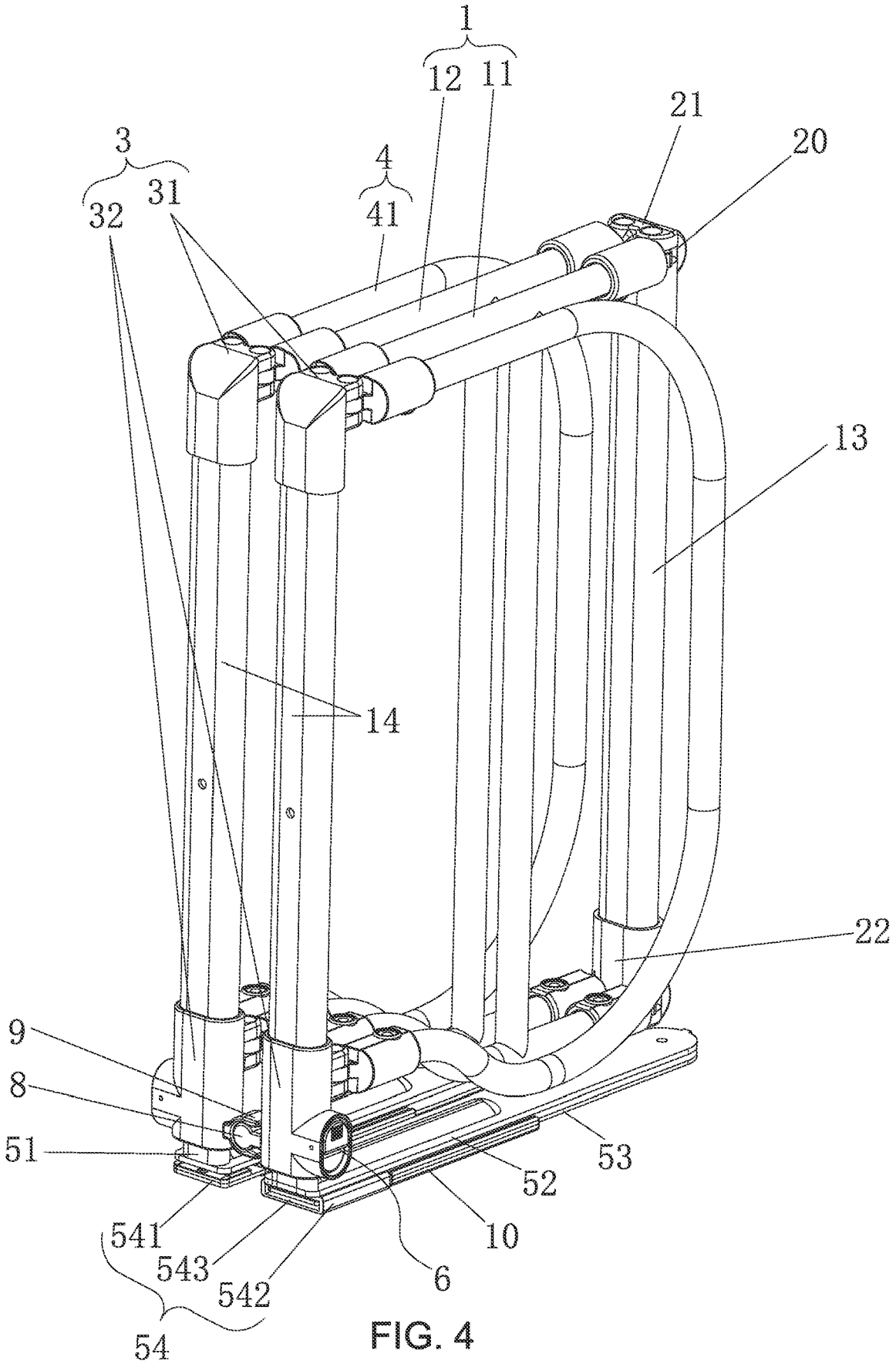
FIG. 4 is a second perspective view of the present invention after folding.

As shown in FIG. 4, after the left guard rail 11 and the right guard rail 12 are folded in half, in order to maintain the folded state of the left guard rail 11 and the right guard rail 12 during carrying, a fixture block 8 is provided on the fourth rotary shaft seat 32 and/or the third rotary shaft seat 31 articulated to the left guard rail 11 together, and a catch 9 which can be in clamped connection to the fixture block 8 is provided on the fourth rotary shaft seat 32 and/or the third rotary shaft seat 31 articulated to the right guard rail 12 together, and after the catch 9 grips and is stuck by the fixture block 8, the folded state of the left guard rail 11 and the right guard rail 12 can be temporarily locked.

Finally, in practical use, the left guard rail 11, the right guard rail 12 and the side frames 41 on the left side and the right side are covered by a cloth cover 200, a plurality of separate cloth covers 200 may be provided and are respectively sleeved on the left guard rail 11, the right guard rail 12, and the side frames 41 on the left side and the right side, or as shown in FIGS. 7 and 8, after the left guard rail 11, the right guard rail 12 and the side frames 41 on the left side and the right side are unfolded to form the whole guard rail, the guard rail is then covered by a whole cloth cover 200.

Although the fundamental principle and essential features of the present invention and advantages thereof are shown and described above, a person skilled in the art should understand that the present invention is not limited by the foregoing embodiment, the foregoing embodiment and the description only describe the principle of the present invention, various changes and improvements of the present invention can further be made without departing from the spirit and scope of the present invention, and these changes and improvements shall fall within the claimed protection scope of the present invention. The claimed protection scope of the present invention is defined by the append claims and their equivalents.

What is claimed is:

1. A multi-segment foldable bed guard rail, comprising:

a guard rail body with foldable and unfoldable extension portions respectively articulated to a left side and a right side of the guard rail body;

wherein a first pivoting member enabling the guard rail body to be folded in half is provided in a middle of the guard rail body, first abutting portions only enabling the guard rail body to be turned by 90 degrees during unfolding are provided on sides of positions where the guard rail body and the first pivoting member are articulated to each other, second pivoting members are respectively articulated to the left side and the right side of the guard rail body, two extension portions are respectively articulated to the second pivoting members on corresponding sides, second abutting portions only enabling the two extension portions to be turned by 90 degrees during unfolding are provided on sides of positions where the second pivoting members are articulated to the two extension portions, and support portions insertable under a mattress is connected to a bottom of the guard rail body;

the second pivoting members comprise third rotary shaft seats and fourth rotary shaft seats, the support portions comprise telescopic vertical rods that are vertically inserted into each of the fourth rotary shaft seats, wherein two support plates are horizontally fixedly connected to bottom ends of the telescopic vertical rods that are respectively extended out below the fourth rotary shaft seats;

wherein two connecting plates are horizontally articulated to ends of the two support plates away from corresponding telescopic rods, and a buckle connecting the two connecting plates together is provided between end portions of the two connecting plates.

2. The multi-segment foldable bed guard rail according to claim 1, wherein the first pivoting member comprises a first rotary shaft seat and a second rotary shaft seat that are arranged spaced apart, the guard rail body comprises a left guard rail articulated to left sides of the first rotary shaft seat and the second rotary shaft seat, and a right guard rail articulated to right sides of the first rotary shaft seat and the second rotary shaft seat, the first abutting portions are provided on sides of axis positions of the first rotary shaft seat and the second rotary shaft seat respectively articulated to the left guard rail and the right guard rail, and the second pivoting members are respectively provided on a left side of the left guard rail and a right side of the right guard rail.

3. The multi-segment foldable bed guard rail according to claim 2, wherein the third rotary shaft seats and the fourth rotary shaft seats are respectively articulated to the left side of the left guard rail and the right side of the right guard rail and are correspondingly provided in a symmetrical manner, and the extension portions are respectively articulated to sides of the adjacent third rotary shaft seat and the adjacent fourth rotary shaft seat away from the guard rail body, the second abutting portions are provided on sides of axis positions of the third rotary shaft seats and the fourth rotary shaft seats articulated to the corresponding extension portions, and the support portions are telescopically provided on the left and right fourth rotary shaft seats respectively.

4. The multi-segment foldable bed guard rail according to claim 3, wherein the bottom ends of the telescopic vertical rods penetrate through bottoms of the fourth rotary shaft seats where the bottom ends are located, and extend out below the fourth rotary shaft seats.

5. The multi-segment foldable bed guard rail according to claim 3, wherein the extension portion comprises a C-shaped frame, with an upper end and a lower end of the frame respectively articulated to outer sides of the adjacent third rotary shaft seat and the adjacent fourth rotary shaft seat.

6. The multi-segment foldable bed guard rail according to claim 2, wherein a middle column is connected between the first rotary shaft seat and the second rotary shaft seat.

7. The multi-segment foldable bed guard rail according to claim 4, wherein hollow side columns are respectively connected between the third rotary shaft seats and the fourth rotary shaft seats connected to the left side of the left guard rail and the right side of the right guard rail, top ends of the telescopic vertical rods penetrate through the fourth rotary shaft seats where the top ends are inserted, to be inserted into the corresponding side columns, and telescopic locking members capable of locking the extending lengths of the telescopic vertical rods are respectively provided on the fourth rotary shaft seats connected to the left side of the left side rail and the right side of the right side rail.

8. The multi-segment foldable bed guard rail according to claim 7, wherein the telescopic locking member comprises an accommodating cavity connected to one side of the fourth rotary shaft seats, an outer side wall of the accommodating cavity facing away from the telescopic vertical rods is open, a first unlocking button turnable in a left-right direction in a bridge plate manner is articulated in the accommodating cavity, a first locking pin is connected to one side of a bottom end of the first unlocking button, a first return spring capable of returning after the first unlocking button generates a seesawing action is connected to one side of a top end of the first unlocking button, and a plurality of first positioning holes for insertion or extraction of the first locking pins are formed in a side wall of the telescopic vertical rod and are sequentially arranged at intervals in a length direction of the telescopic vertical rods.

9. The multi-segment foldable bed guard rail according to any claim 2, wherein main guard rail locking devices capable of locking the left guard rail and the right guard rail in a straight line state after unfolding are respectively provided on the first rotary shaft seat and the second rotary shaft seat;

the main guard rail locking device comprises accommodating cavities respectively formed in the first rotary shaft seat and the second rotary shaft seat, guide columns are vertically provided in the accommodating cavities, and the guide columns are sleeved with bearing plates;

second positioning holes are formed in sides of axes of articulated shafts of the left guard rail and the right guard rail respectively articulated to the first rotary shaft seat and the second rotary shaft seat, insertion holes capable of being in communication with the accommodating cavities respectively are formed in the first rotary shaft seat and the second rotary shaft seat at positions corresponding to the second positioning holes, and positioning columns capable of penetrating through the insertion holes to be inserted into the corresponding second positioning holes are respectively provided on the bearing plates;

pressing rods capable of extending out of the first rotary shaft seat and the second rotary shaft seat where the pressing rods are located are further provided on the bearing plates, and the guide columns are sleeved with second return springs capable of resetting again after the pressing rods drive the bearing plates to displace along the guide columns, one end of each of the second return springs pressing against an end portion of the corresponding guide column, and the other end pressing against a bottom of one corresponding bearing plate.

10. The multi-segment foldable bed guard rail according to claim 1, wherein the buckle comprises a male fastening element provided at an end portion of one of the connecting plates and a female insertion slot provided at an end portion of the other of the connecting plates, a side wall of an end portion of the female insertion slot has an insertion port capable of allowing the male fastening element to be inserted, a snap-fit opening that in communicated with the insertion port penetrates a top of the female insertion slot, a top of the male fastening element has a snap with a tail end capable of upwarping, and after the snap is inserted into the insertion port along with the male fastening element, the tail upwarps to be snapped into the snap-fit opening.

11. The multi-segment foldable bed guard rail according to claim 3, wherein a fixture block is provided on the fourth rotary shaft seats and/or the third rotary shaft seats articulated to the left guard rail together, and a catch that is in clamping connection with the fixture block is provided on the fourth rotary shaft seats and/or the third rotary shaft seats articulated to the right guard rail together.

12. The multi-segment foldable bed guard rail according to claim 1, wherein the two connecting plates are respectively sleeved with anti-slip rubber sleeves.

13. The multi-segment foldable bed guard rail according to claim 1, wherein angle limiting pieces capable of cooperating with each other to limit rotation angles of the connecting plates relative to the articulated support plates are provided at positions where the connecting plates are articulated to the support plates; the angle limiting piece comprises a first limiting part extending out upwards and provided on a side wall of the connecting plate close to an end portion, and a second limiting part fixedly provided on a side wall of a corresponding end portion of the support plate, and a side wall of the first limiting part presses against a side wall of the second limiting part after the first limiting part rotates by 90 degrees along with the connecting plate.

14. The multi-segment foldable bed guard rail according to claim 1, wherein the left guard rail, the right guard rail and the frames on the left and right sides are sleeved with a cloth cover.

* * * * *